United States Patent [19]

Kubota et al.

[11] 4,231,152

[45] Nov. 4, 1980

[54] METHOD AND APPARATUS FOR PRESS-FITTING CAPS ON ELECTRONIC PARTS AND THE LIKE

[75] Inventors: Shigeru Kubota, Tokyo; Seiji Kano, Yokohama; Masahiro Kubo, Machidashi, all of Japan

[73] Assignee: Nitto Kogyo K.K., Tokyo, Japan

[21] Appl. No.: 881

[22] Filed: Jan. 4, 1979

[30] Foreign Application Priority Data

Jan. 19, 1978 [JP] Japan ..... 53/4456

[51] Int. Cl.[3] ..... H01C 17/28

[52] U.S. Cl. ..... 29/621; 29/525; 29/742; 29/747

[58] Field of Search ..... 29/628, 718, 747, 759, 29/33 R, 619, 621, 525, 742

[56] References Cited

U.S. PATENT DOCUMENTS

| | | | |
|---|---|---|---|
| 209,619 | 11/1878 | Loomis | 29/1.22 |
| 3,200,471 | 8/1965 | Johnson et al. | 29/759 X |

FOREIGN PATENT DOCUMENTS

| | | | |
|---|---|---|---|
| 911938 | 12/1962 | United Kingdom | 29/628 |

*Primary Examiner*—Francis S. Husar

*Assistant Examiner*—C. J. Arbes

*Attorney, Agent, or Firm*—Oblon, Fisher, Spivak, McClelland & Maier

[57] ABSTRACT

Method and apparatus are provided for press-fitting caps on electric parts and the like. The apparatus has a device for feeding component rods of electric parts to a rod-conveying wheel provided on its circumference with lateral equally spaced grooves for receiving the rods fed from the rod-feeding device one by one, and a cap-feeding device for feeding caps to a pair of cap-conveying wheels each provided on its circumference with lateral equally-spaced grooves for receiving the caps fed from the cap-feeding device, the cap-conveying wheels being arranged symmetrically and obliquely with respect to the rod-conveying wheel so that the lower ends thereof come in contact with the lower end of the rod-conveying wheel thereby to press-fit the caps on the rods successively, and the rod-conveying and cap-conveying wheels being rotated in synchronization with one another. The method performed using the above apparatus comprises: feeding the rods onto the lateral grooves of the rod-conveying wheel one by one, feeding the caps onto the lateral grooves of the cap-conveying wheels one by one, and press-fitting the caps on both ends of the respective rods in succession.

6 Claims, 10 Drawing Figures

METHOD AND APPARATUS FOR PRESS-FITTING CAPS ON ELECTRONIC PARTS AND THE LIKE

BACKGROUND OF THE INVENTION

1. Field of the Invention

The present invention relates to a method and apparatus for press-fitting caps on electronic parts and the like and, more particularly, to an improved method and apparatus for press-fitting caps to be used as electrode terminals on both ends of each electronic part, such as a resistive component rod of a small-sized resistor.

2. Description of the Prior Art

In such small-sized electronic parts as small-sized resistors, the component rod is usually about 6 mm in length and about 1.5–2 mm in diameter, and the cap is about 2–3 mm in length and about 2–2.5 mm in diameter. For the purpose of press-fitting these caps on such rods, it has been a usual practice to adopt the following apparatus and method.

The rods are suitably fed and placed in lateral grooves provided on the circumference of a wheel and thereby are conveyed. Caps suitably supplied are held by a chuck adapted to be three-dimentionally driven by a cam system. The chuck is intermittently operated to press-fit the caps on the rods.

This apparatus, however, is complicated in construction and operation. The operating stroke of the chuck is large. Therefore, the high-speed operation of the apparatus is limited and a production of about 200 to 300 products per minute is possible at most.

In the usual cap-feeding means heretofore used, caps are gravitationally transferred from a cap supply source, or a cap container, onto a pair of cap-conveying wheels so that they are placed one by one in the lateral grooves provided on the internal sides of the circumferences of the respective cap-conveying wheels. It seems possible to provide a rod-feeding means in the same manner as with the cap-feeding means by gravitationally transferring the rods onto a rod-conveying wheel so that the rods are placed one by one in the lateral grooves provided on the circumference of the rod-conveying wheel. However, provision of such rod-feeding means makes it difficult to afford a sufficient space between the upper side of each cap-conveying wheel and that of the rod-conveying wheel for providing a guide device for making the rods gravitationally fall. In addition, it is also difficult to sufficiently widen such a space, because, if this space is widened, the operation of fitting the caps on the rods will be hampered.

SUMMARY OF THE INVENTION

Therefore, it is an object of the present invention to provide a method and apparatus for press-fitting caps on electronic parts and the like which eliminates the above-mentioned disadvantages of the prior art.

It is another object of the present invention to provide a method and apparatus for press-fittinng caps on electronic parts and the like which performs operations at a high speed several times as great as the prior art.

It is still another object to provide a method and apparatus for press-fitting caps on electronic parts and the like which performs operations securely, accurately, smoothly, easily and efficiently in a simplified manner.

According to the present invention, component rods and caps held in separate containers are gravitationally fed onto a rod-conveying wheel provided in the middle and a pair of cap-conveying wheels provided at both sides of the rod-conveying wheel, respectively. The cap-conveying wheels are obliquely positioned so that their lower ends are in contact with the lower end of the rod-conveying wheel. At this contact point, the caps are press-fitted on both ends of each rod to form rod-and-cap assemblies. These assemblies are transferred onto a take-up wheel and, during conveying, the caps are completely press-fitted on both sides of each rod by press rollers.

Besides, according to the present invention, a rod-guiding wheel is provided above and opposite to the rod-conveying wheel so that it avoids the position of the cap-feeding device and so that the rods can be inserted laterally into lateral grooves provided on the circumference thereof one by one and so that the rods thereon are transferred onto the rod-conveying wheel one by one.

BRIEF DESCRIPTION OF THE ACCOMPANYING DRAWINGS

DETAILED DESCRIPTION OF THE PREFERRED EMBODIMENTS

Figure 1:
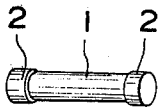
FIG. 1 is a schematic perspective view of an electronic part, showing caps press-fitted on a component rod.

The preferred embodiments of the present invention will be hereinafter described with reference to the accompanying drawings in which like reference characters designate corresponding parts.

In FIG. 1, reference numeral 1 designates a resistive component rod, as of ceramics, for each electric resistor, and reference numerals 2 designate metal caps forced or press-fitted on both ends of each resistive rod 1, respectively.

According to the present invention, the above-mentioned metal caps 2 can be press-fitted or forced on the above-mentioned resistive rods 1 successively using the following apparatus.

Figure 2:
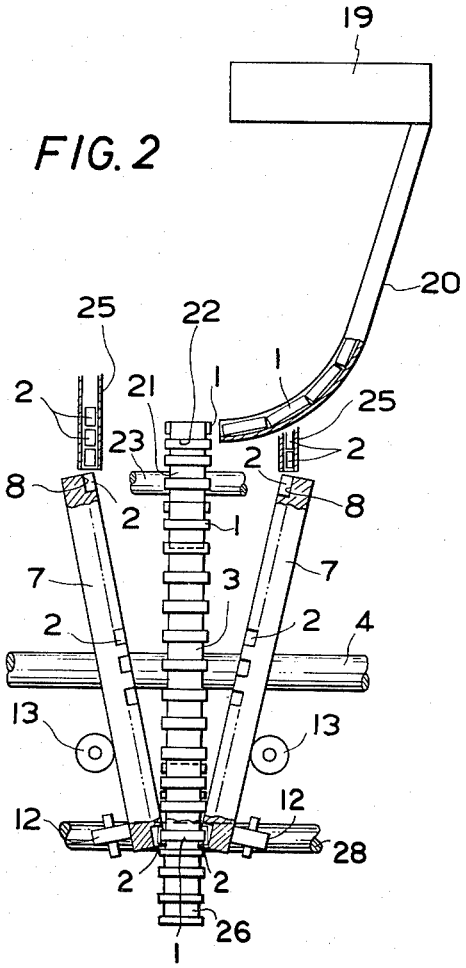
FIG. 2 is a schematic elevational view of an apparatus according to the present invention, showing the relationship between the rod-conveying wheel and the cap-conveying wheels.
Figure 3:
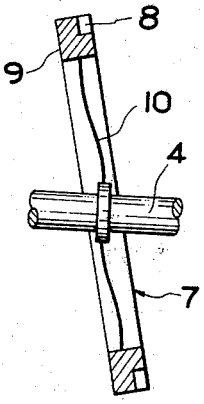
FIG. 3 is a schematic sectional view of a cap-conveying wheel according to the present invention.
Figure 4:
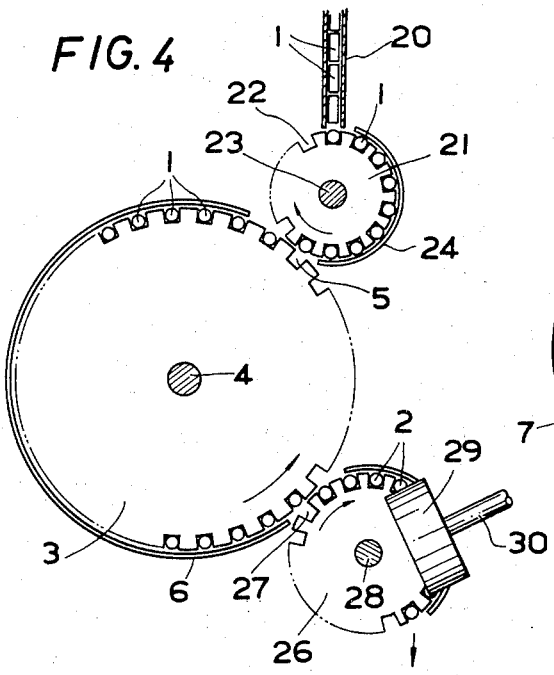
FIG. 4 is a schematic fragmentary side view of an apparatus of the present invention, showing the relationship between the rod-conveying wheel, rod-guiding wheel and rod-take-up wheel.
Figure 5:
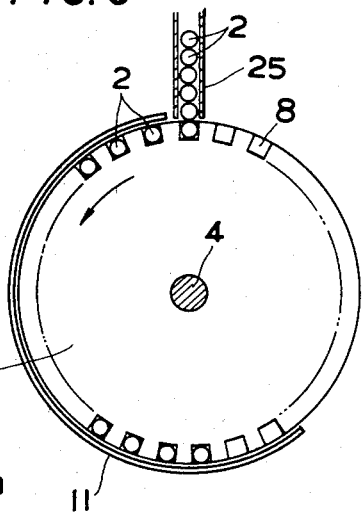
FIG. 5 is a schematic side view of a cap-conveying wheel according to the present invention.
Figure 6:
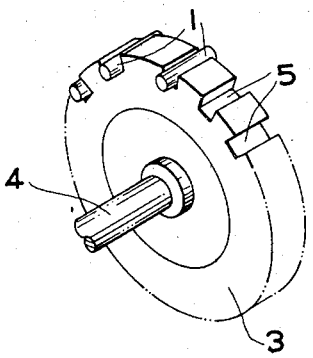
FIG. 6 is a perspective view of a rod-conveying wheel according to the present invention.
Figure 7:
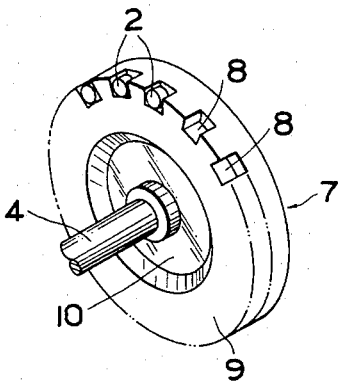
FIG. 7 is a perspective view of a cap-conveying wheel according to the present invention.
Figure 8:
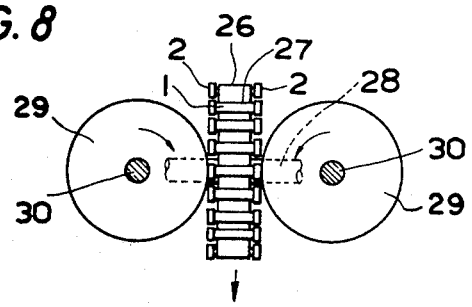
FIG. 8 is a schematic fragmentary elevational view of an apparatus of the present invention, showing a rod-and-cap assembly taking-up wheel and press rollers.

Reference is made to FIGS. 2 to 10, wherein reference numeral 3 designates a rod-conveying wheel fixed on a rotary shaft 4 and driven by a driving device (not shown). The rod-conveying wheel 3 is provided on its entire circumference with lateral grooves 5 adapted to receive the rods 1 and sized and spaced according to the length and diameter of the rods 1. Reference numeral 6 designates a guide provided in the vicinity of the circumference of the rod-conveying wheel 3 for preventing slipping-off of the rods 1 placed in the grooves 5 as will be later described. In FIG. 2, reference numerals 7 designate a pair of cap-conveying wheels mounted on the rotary shaft 4 and adapted to rotate together with the rod-conveying wheel 3. Reference numerals 8 designate lateral grooves provided on the inside surface of the entire circumference of each cap-conveying wheel 7 for receiving the caps 2 as will be later described. The grooves 8 are sized and spaced according to the length and diameter of the caps 2. In the example shown in FIG. 3, the cap-conveying wheel 7 is composed of an annular circumferential member 9 on which the lateral grooves 8 are provided and a disc 10 formed of an elastic steel sheet and positioned inside the member 9, and the central portion of the disc 10 is fixed on the rotary shaft 4. Reference numeral 11 designates a guide provided in the vicinity of the circumference of the cap-conveying wheel 7 for preventing slipping-off of the caps 2 arranged in the grooves 8 as will be later described. As shown in FIG. 2, rollers 12 and 13 are provided under the cap-conveying wheels 7 so that they at all times urge the lower portions of the wheels 7 inward toward the lowermost portion of the rod-conveying wheel 3 which is positioned between the wheels 7. Thus, when the shaft 4 is driven to rotate, the wheels 7 are rotated with their lowermost parts in contact with the lowermost part of the wheel 3 so that the lateral grooves 5 on the wheel 3 are moved in synchronization with the lateral grooves 8 on the wheels 7 while the former are mating with the latter side by side at the lowermost positions. In this example, as mentioned above, the disc 10 of the cap-conveying wheel 7 is formed of a resilient steel sheet of about 0.2 mm thickness so as to make the wheel 7 capable of axially inclining and give it a restoring force when inclined.

Figure 9:
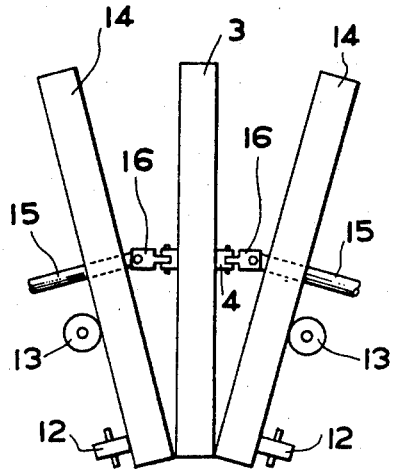
FIGS. 9 and 10 show other examples of the cap-conveying wheels according to the present invention.

However, as shown in another example in FIG. 9, a pair of cap-conveying wheels 14 each formed of a rigid member in its entirety may be provided instead of the elastic wheels 7 shown in the above-mentioned example. Each wheel 14 has a rotary shaft 15 connected to the rotary shaft 4 of the rod-conveying wheel 3 through a universal joint 16 so that the wheels 14 are inclined with respect to the wheel 3.

Figure 10:
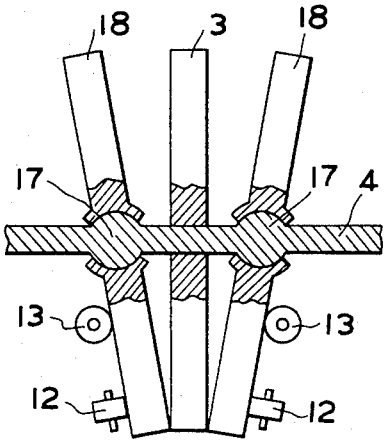

Furthermore, as shown in still another example of FIG. 10, a pair of cap-conveying wheels 18 each formed of a rigid member in its entirety may provided instead of the elastic wheels 7. The wheels 18 are mounted on the rotary shaft 4 through ball joints 17 provided thereon, respectively, so that they can be rotated while inclining with respect to the wheel 3.

In FIG. 2, reference numeral 19 designates a rod container in which a centrifugal vibrating board (not shown) vibrates the rods 1 to place them in a row thereby making them fall into a feed pipe 20. Reference numeral 21 designates a rod-guiding wheel which is provided on its circumference with lateral grooves 22 arranged at predetermined intervals and which is fixed on a rotary drive shaft 23. In addition, the rod-guiding wheel 21 is related to the cap-guiding wheel 3 so that the lateral grooves 22 on the wheel 21 face the lateral grooves 5 on the wheel 3 and so that the wheel 21 is rotated in synchronization with and at the same circumferential speed as the wheel 3. The feed pipe 20 extends downward to reach the side of the lateral grooves 22 on the wheel 21 so that the rods 1 fed through the feed pipe 20 are automatically and gravitationally transferred from the feed pipe 20 laterally to the grooves 22 one by one as the wheel 21 rotates. The rods 1 thus placed in the grooves 22 on the wheel 21 are held in place by the aid of a guide 24 provided in the vicinity of the circumference of the wheel 21, being guided toward the rod-conveying wheel 3 and transferred gravitationally to the wheel 3 one by one as the wheel 21 rotates. With this arrangement, the rods 1 can be fed to the wheel 3 more accurately, more smoothly and more rapidly than in the case of the conventional arrangement in which the rods 1 are fed directly to the grooves 5 from above.

Reference numeral 25 designates cap-guiding pipes communicating with a cap container (not shown) and adapted to gravitationally feed the caps to the lateral grooves 8 of the wheels 7, respectively.

When thus the rods 1 and caps 2 are placed in the grooves 5 and 8 of the wheels 3 and 7, respectively, and the rotary shaft 4 is rotated, the rods 1 and caps 2 approach each other as they lower because the wheels 7 are inclined with respect to the wheel 3. As a result, when each rod 1 reaches its lowermost position, the caps 2 are fitted on the rod 1. Rod-and-cap assemblies thus formed are moved along the guide 6, being gravitationally transferred onto lateral grooves 27 provided at predetermined intervals on the circumference of a take-up wheel 26 disposed adjacent, to the wheel 3 in opposed relationship thereto. The take-up wheel 26 is fixed on a rotary drive shaft 28, being rotated in synchronization with and at the same circumferential speed as the wheel 3. A pair of press rollers 29 and 29 are provided with the wheel 26 therebetween so as to externally press the above-mentioned assemblies thereby to completely force the caps 2 onto the rods 1. The rollers 29 are fixed on rotary drive shafts 30, being rotated at the same circumferential speed as the wheel 26.

With the construction as mentioned above, the caps 2 are completely forced on the rods 1, and the rod-and-cap assemblies are guided by a suitable guide and gravitationally fall before being taken out.

In the above-mentioned preferred embodiments, the rod-conveying wheel 3 is about 150 mm in diameter and smaller in width than the length of the rod 1, being provided on its entire circumference with about one hundred grooves 5 and rotated at about 10 rpm. In this manner, the caps 2 can be completely forced on both ends of each rod 1 very smoothly.

According to the present invention, electronic parts such as resistors can be securely, smoothly and efficiently produced using a simplified apparatus.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A method of press-fitting caps on electronic parts and the like, comprising the steps of:

feeding component rods of electronic parts laterally from a supply into transverse notches of a rod guiding wheel, and from the rod guiding wheel into transverse notches of a rod conveying wheel;

rotating a pair of cap conveying wheels in synchronization with the rod conveying wheel and disposing the cap conveying wheel symmetrically and obliquely with respect to the rod conveying wheel on opposite sides thereof and in contacting relationships therewith on the opposite sides of the bottom part of the rod conveying wheel;

feeding caps from a supply into a plurality of transverse notches in the inner peripheral part of each cap conveying wheel;

pressing the caps onto the ends of the rods as the rod and cap conveying wheels are rotated;

feeding the assembled rods and caps one-by-one and sequentially from the notches of the cap conveying wheel into corresponding transverse notches of a take-up wheel rotated in synchronized, opposed relation to the rod conveying wheel; and pressing the caps firmly onto the rods with a pair of press rollers rotated in pressing contact with the caps at opposite sides of the take-up wheel.

2. The apparatus as set forth in claim 1, wherein the drive means comprises a drive shaft extending through the centers of the rod conveying wheel and the cap conveying wheels and being common thereto, said cap conveying wheels being connected to the shaft by connecting means permitting rotation of the cap conveying wheels obliquely with respect to the shaft.

3. The apparatus as in claim 2, wherein the connecting means comprises a flexible disc center in the cap conveying wheels, said center being connected between the shaft and an annular, ring shaped peripheral part of the wheel in which the grooves are formed.

4. The apparatus in claim 2, wherein the connecting means comprises a ball and socket joint between the shaft and the center of each cap conveying wheel.

5. An apparatus for press-fitting caps on electronic parts and the like, comprising;

a rod feeding device for feeding component rods of electronic parts;

a rod conveying wheel provided on its circumference with lateral grooves disposed at predetermined intervals and adapted to receive and convey said rods fed from said rod-feeding device;

a device for feeding caps;

a pair of cap conveying wheels each provided on one side of its circumference with lateral grooves disposed at predetermined intervals so as to receive and convey the caps fed from said cap-feeding device;

said cap conveying wheels being arranged symmetrically and obliquely with respect to said rod conveying wheel on opposite sides thereof so that the lower ends thereof come in contact with the lower end of said rod conveying wheel, thereby press-fitting the caps on both ends of the respective rods to form rod and cap assemblies;

a rod and cap assembly take-up wheel positioned adjacent the lower end of the rod conveying wheel and provided on its circumference with lateral grooves disposed at predetermined intervals for receiving the rod and cap assemblies from said rod conveying wheel one-by-one;

press rollers provided at both sides of and in the vicinity of said wheel for completely press-fitting the caps on the rods by externally pressing both ends of the respective rod and cap assemblies while being conveyed by said take-up wheel;

and a drive means for rotating all of said wheel in synchronization with one another and at the same circumferential speed.

6. The apparatus as set forth in claim 2, wherein said rod feeding device is composed of a rod supply source and a rod guiding wheel provided on its circumference with lateral grooves disposed at predetermined intervals and positioned to laterally receive the rods fed from said rod supply source one-by-one, said rod-guiding wheel conveying the rods and being rotated at the same circumferential speed as said cap conveying wheel and positioned adjacent the cap conveying wheel so that the rods thereon are transferred onto the lateral grooves of said cap conveying wheel one-by-one, whereby lateral feed of the rods from a rod supply source is possible without interfering with feed of caps to the apparatus.

* * * * *